US005952918A

United States Patent [19]

Ohayon

[11] Patent Number: 5,952,918

[45] Date of Patent: Sep. 14, 1999

[54] RECOVERY MODE FEATURE FOR REMOTE UNITS

[76] Inventor: Shalom Ohayon, 6618 - 20th Ave., Brooklyn, N.Y. 11204

[21] Appl. No.: 08/974,803

[22] Filed: Nov. 20, 1997

Related U.S. Application Data

[63] Continuation of application No. 08/154,071, Nov. 18, 1993, abandoned.

[51] Int. Cl.[6] ..... G08B 1/08

[52] U.S. Cl. ..... 340/539; 340/311.1; 340/825.49; 340/571; 455/575

[58] Field of Search ..... 340/539, 568.1, 340/571, 825.49, 311.1; 455/567, 575

[56] References Cited

U.S. PATENT DOCUMENTS

| | | | |
|---|---|---|---|
| 4,101,873 | 7/1978 | Anderson et al. | 340/539 |
| 4,476,469 | 10/1984 | Lander | 340/539 |
| 4,868,561 | 9/1989 | Davis | 340/311.1 |
| 4,884,294 | 11/1989 | Inagami | 379/61 |
| 5,294,915 | 3/1994 | Owen | 340/539 |

FOREIGN PATENT DOCUMENTS

| | | | |
|---|---|---|---|
| 0314994 | 12/1988 | Japan | 340/825.49 |
| 0171396 | 7/1989 | Japan | 340/825.49 |
| 3-293895 | 12/1991 | Japan | H04Q 8/00 |
| 9117634 | 11/1991 | WIPO | 340/825.49 |

*Primary Examiner*—Daniel J. Wu
*Attorney, Agent, or Firm*—Ostrolenk, Faber, Gerb & Soffen, LLP

[57] ABSTRACT

An apparatus for locating and recovering a misplaced remote unit includes a base unit including a radio frequency transmitter adapted to produce radio signals in response to a user command and a remote unit adapted to control at least one function of the base unit. The remote unit includes a radio frequency receiver adapted to receive the radio signals from the radio frequency transmitter, and an audio circuit adapted to produce audible musical signals as sensory input to the user in response to the received radio signals. The musical signals are capable of calming the user when the user is under stress such that location and recovery of the remote unit may be obtained.

15 Claims, 7 Drawing Sheets

RECOVERY MODE FEATURE FOR REMOTE UNITS

CROSS REFERENCE RELATED APPLICATION

This is a Continuation of application Ser. No. 08/154,071 filed on Nov. 18, 1993, now abandoned.

BACKGROUND OF THE INVENTION

1. Field of the Invention

The present invention relates to a recovery mode feature for remote units which enables a user to easily and quickly locate and recover the remote unit and, more particularly, to a recovery mode feature employing both musical sound and light to assist the user in locating and recovering the remote unit.

2. Related Art

The use of remote units, such as control units for televisions, stereos, VCR's and the like, as well as telephones etc. are widely used. Users of these remote units tend to misplace the units and subsequently forget where they are located within a home, place of business, or the like. Consequently, valuable time is lost in searching for misplaced remote units, which may elevate users' distress levels, particularly in times of emergency.

It is known that human beings are less receptive to sensory input when under stress. Indeed, high stress levels in human beings are characterized by increased adrenaline levels, rapid heart beat, shallow and rapid respiration, all causing a person to become less rational and less capable of focusing, prioritizing and completing tasks. For example, when a person is faced with a life or death situation, his or her stress level is likely to be elevated causing that person to be less responsive to sensory inputs, such as audible sounds and visual stimuli. When in such a state, a person is less likely to be able to calmly and rapidly locate a misplaced remote unit, such as a cordless telephone handset.

Therefore, in emergencies, it is very difficult for the user to find a misplaced remote unit because his or her adrenaline level increases and substantially prevents the user from focusing on the task at hand, namely, finding the remote unit.

Further, it is known that noise pollution is undesirable and should be avoided because prolonged exposure of humans to noise pollution has negative affects on human health.

Consequently, there is a need in the art to provide a remote unit with the capability of emitting a musical audible output as part of a locating and recovering feature such that the audible music provides a calming effect on the user, thereby becoming an input stimuli to which a panicking user will respond.

SUMMARY OF THE INVENTION

In accordance with the invention, a remote unit includes a base unit including a radio frequency transmitter adapted to produce radio signals in response to a user command and a remote unit adapted to control at least one function of the base unit. The remote unit includes a radio frequency receiver adapted to receive the radio signals from the radio frequency transmitter, and an audio circuit adapted to produce audible musical signals as sensory input to the user in response to the received radio signals. The musical signals are capable of calming the user when the user is under stress such that location and recovery of the remote unit may be obtained.

Other features and advantages of the present invention will become apparent from the following description of the invention which refers to the accompanying drawings.

BRIEF DESCRIPTION OF THE DRAWINGS

For the purpose of illustrating the invention, there is shown in the drawing a form which is presently preferred, it being understood, however, that the invention is not limited to the precise arrangement and instrumentality shown.

DETAILED DESCRIPTION OF THE PREFERRED EMBODIMENTS

Figure 1:
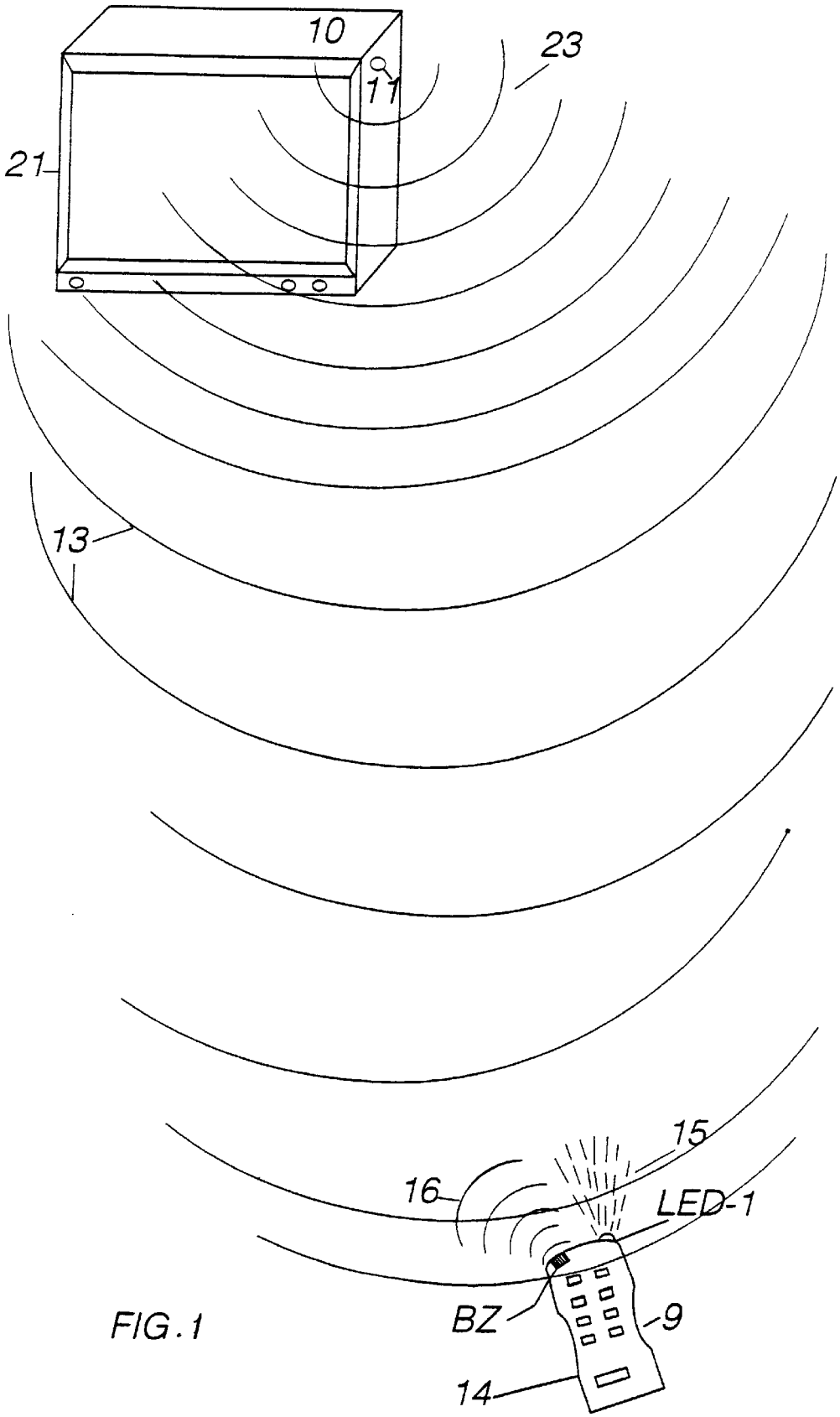
FIG. 1 is a diagram of a base unit and remote unit employing the location and recovery mode feature of the present invention.

Referring now to the drawings wherein like numerals indicate like elements, there is shown in FIG. 1 a system 23 employing the location and recovery mode feature of the present invention. The system 23 includes a base unit 21, such as a remotely controlled electronic instrument or a wireless telephone cradle. The system 23 also includes a remote unit 14, such as an infra red control unit for controlling the electronic instrument. The remote unit 14 may also be a handset for a wireless telephone.

The base unit 21, shown as a television set, includes a radio transmitter 10 capable of transmitting radio signals to the remote unit 14 and a transmitter activation button (or recovery button) 11. The transmitter 10 is powered at all times and will send a radio frequency recovery signal 13 when the recovery button 11 is pressed.

It is understood that the remote unit 14 may include an infra red transmitter which communicates with an infra red receiver of the base unit 21 when the base unit 21 is, for example, a television set. Such an infra red link between the base unit 21 and the remote unit 14 facilitates such functions as channel changing, volume control, on/off functions, and the like. When the remote unit 14 is the handset of a wireless telephone, however, it is understood that the remote unit 14 includes a radio frequency transmitter/receiver for communicating with the base unit 21, i.e., the cradle of the wireless telephone.

Irrespective of whether the remote unit 14 controls or communicates with the base unit 21 via radio frequency signals or infra red signals, the remote unit 14 includes a radio frequency receiver 9 capable of receiving the radio frequency signals 13 from the transmitter 10. The radio frequency receiver 9 is coupled to audio circuitry (not shown) and lighting circuitry (not shown), which circuits are adapted to activate in response to the reception of the radio frequency signals 13. In particular, when the recovery button 11 is pressed, the transmitter 10 produces the radio frequency signals 13, the receiver 9 receives the radio frequency signals 13, and at least one of the audio circuit and lighting circuity activates in response thereto.

The remote unit 14 also includes a mini sounder BZ for generating sound effects, such as beeping, buzzing, or preferably producing a musical sound. Since beeping and/or buzzing produce harsh sounds, a user subject thereto will experience alarm and, therefore, will be subject to increased adrenaline levels, particularly in emergency situations. It is preferred, therefore, that the audio circuit and mini sounder BZ are adapted to produce musical sound in order to calm the user during emergency situations, and/or situations in which the user is under stress.

Advantageously, when the recovery button 11 is pressed, the musical sound emanating from the mini sounder BZ will provide the function of locating the remote unit 14, i.e., the mini sounder BZ will produce sensory input (sound signals 16) to the user which will cause the user to begin to search for the source of the sound signals 16. Moreover, when the sound signals 16 are musical sounds, the sensory input to the user will have a calming effect and, therefore, reduce adrenaline production in the user which will enable the user to recover the remote unit 14, particularly during periods of elevated stress and/or emergencies. Indeed, it is critical that the sound signals 16 emanating from the remote unit 14 be capable of reducing anxiety in the user in order for the sensory input to penetrate the consciousness of the user so that the remote unit 14 may be recovered.

The remote unit 14 preferably also includes a light emitting device 1, for example a light emitting diode (LED), which operates simultaneously with the mini sounder BZ to produce a steady light, flashing light, or the like in order to provide another sensory input (light signal 15) to the user. Therefore, in a darkened room or other low light environment, combining the light and musical signals 15, 16 will enable quick recovery of the remote unit 14. It is noted that the light signal 15 will provide a preferred sensory input for users with hearing disabilities.

As may be seen in FIG. 1, the mini sounder BZ and light emitting diode 1 are disposed on a casing surface of the remote unit 14 to enable transmittance of the light signal 15 and musical sound signals 16 into the environment in which the remote unit 14 is located.

Figure 2:
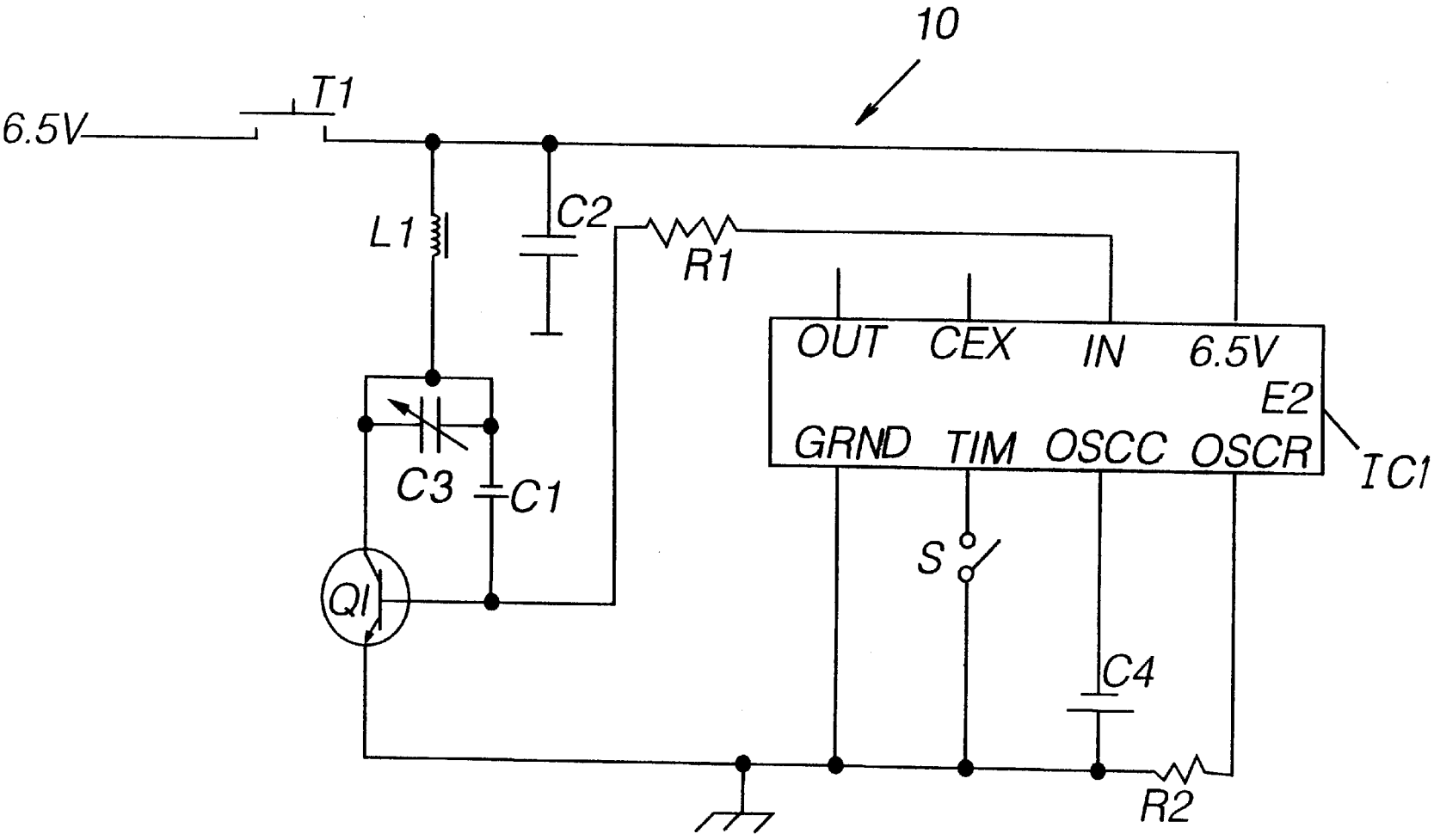
FIG. 2 is a schematic diagram showing a radio frequency transmitter for use in a base unit in accordance with the present invention.

With reference to FIG. 2, a preferred transmitter 10 is shown in schematic form. The transmitter 10 includes a source of DC power, preferably 6.5 volts coupled to an oscillator circuit. It is preferred that the transmitter 10 be hand wired to the main electronics of the base unit 21 in order to receive power therefrom. The oscillator circuit includes IC1, coupled to an active tank circuit. IC1 is activated by way of momentary contact switch S, which switch S is coupled to recovery button 11 (FIG. 1). It is noted that IC1 is continuously powered via the 6.5 volt DC source (or VCC), but does not become active until momentary contact switch S is engaged. A capacitor C4 and resistor R2 are respectively coupled between OSCC and OSCR terminals of IC1 to ground and are selected to set the internal oscillator frequency of IC1. Capacitor C2 provides local energy storage and decoupling capacitance for IC1.

Transmitter 10 also includes a tank circuit comprising inductor L1, variable capacitor C3, capacitor C1 and transistor Q1. Inductor L1 is preferably a strip-line type inductor formed as part of the printed circuit board as is known in the art. Inductor L1, and capacitors C3 and C1 are coupled to form a tank circuit where inductor L1 provides a high impedance between the tank circuit and the 6.5 volt DC source. Variable capacitance C3 is adapted to provide a frequency adjustment for the transmitter 10.

In response to the momentary switch S, IC1 bias transistor Q1 on through base drive current limiting resistor R1, thereby activated the transmitter 10. Consequently, transmitter 10 produces radio frequency signals via an internal antenna to produce the radio frequency signals 13.

Figure 3:
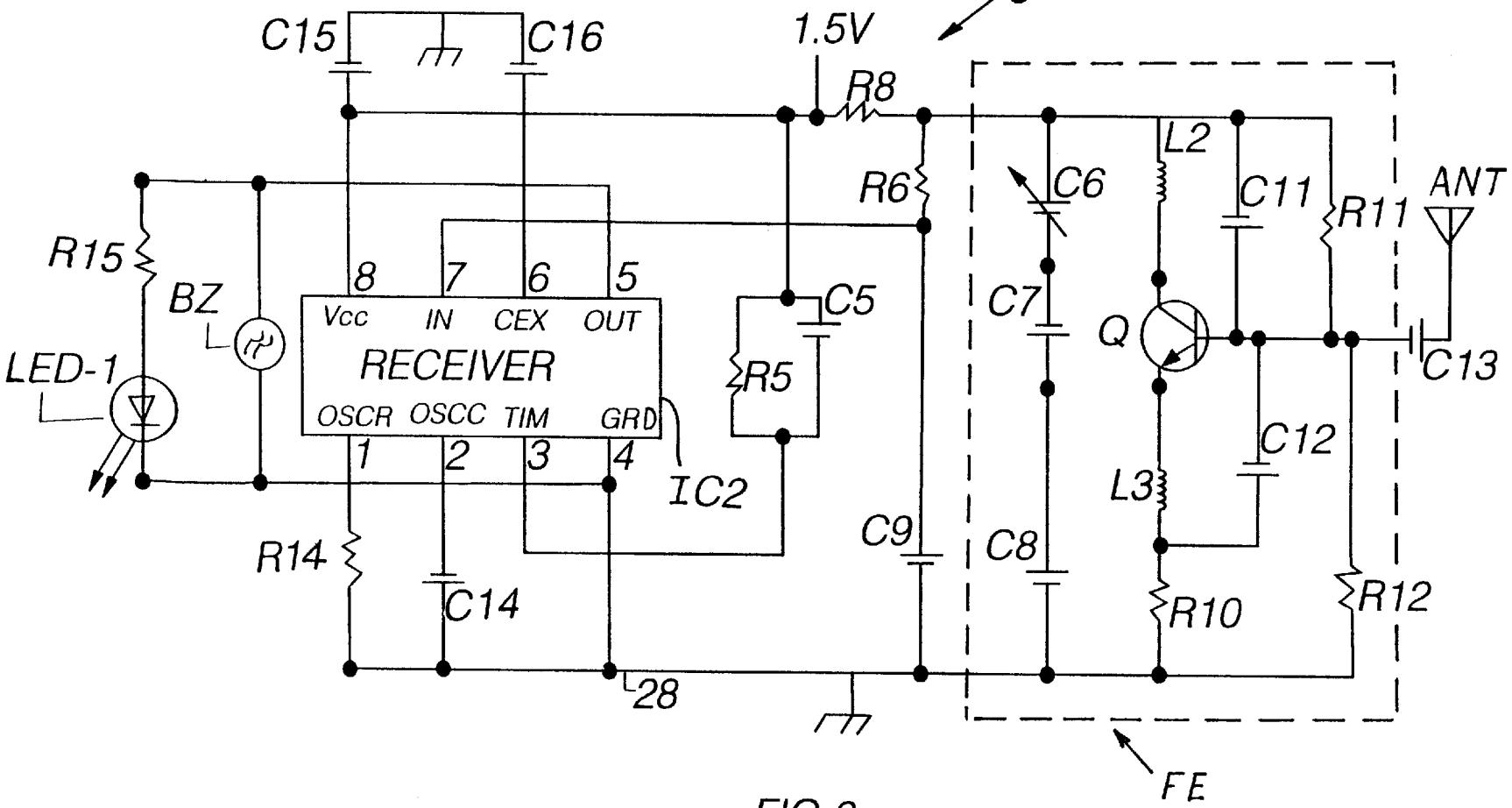
FIG. 3 is a schematic diagram showing a radio frequency receiver for use in a remote unit in accordance with the present invention.

With reference to FIG. 3, a preferred receiver 9 is shown in schematic form. The receiver 9 includes an antenna ANT, an RF-tuned front end amplifier FE and a receiver circuit. Antenna ANT is coupled to the tuned amplifier FE via coupling capacitor C13. An amplifier element Q is tuned to respond to a particular radio frequency signal received by antenna ANT. Circuit elements C11, C12, L2, L3, C6, C7, and C8 are operatively coupled to transistor Q to tune the RF-tuned front end amplifier FE. Resistor R8 and R10 provide DC bias for amplifier FE. Preferably, capacitor C6 is a variable capacitor which enables the tuned amplifier FE to be adjusted.

A low pass filter, formed by resistor R6 and capacitor C9 couples the tuned amplifier FE to the receiver circuit. The receiver circuit includes an integrated circuit IC2, timing elements R14 and C14, and pulse setting components CS and R5. IC2 receives operating power from a 1.5 volt DC source which is input to pin 8, i.e., VCC. A power supply filtering capacitor C15 provides local energy storage and decoupling for IC2. Capacitor C14 and resistor R14 are selected to set an internal oscillator frequency while capacitor C5 and resistor R5 are selected to set an output pulse duration from IC2.

Light emitting diode 1 is coupled in parallel with mini sounder BZ through R15 which produce the light signals 15 and sound signals 16 as discussed above. IC2 is operatively coupled to LED 1 and mini sounder BZ via output terminal (pin 5). IC2 includes an internal audio amplifier having a gain value which is determined by the value of capacitor C16.

Advantageously, the circuit of FIG. 3 operates from a relatively low source of DC power (i.e., 1.5 volts), thereby enabling relatively long term use of the remote unit 14 despite the power drawn from the receiver 9.

Preferably, an EEPROM (not shown) is operatively coupled to IC2 such that music data may be stored in the EEPROM and delivered to IC2 for output to the mini sounder BZ. Consequently, soothing music data may be programmed into the EEPROM for delivery to the user as sound signals 16 when required.

When the recovery button 11 (FIG. 1) is pressed, the radio frequency signals 13 are transmitted from the transmitter 10 within the base unit 21. The radio frequency signals 13 are received by the antenna ANT (FIG. 3) and cause the amplifier FE to produce an output. The output is coupled to IC2 through the low pass filter formed by R6 and C9 such that IC2 is activated and outputs voltage signals to at least one of the mini sounder BZ and light emitting diode 1. As discussed above, it is preferred that music data from an EEPROM is delivered to IC2 such that the sound signals 16 emanating from the mini sounder BZ are music signals capable of alerting a user as to the location of the remote unit 14 without increasing the stress level of the user.

Figure 4A:
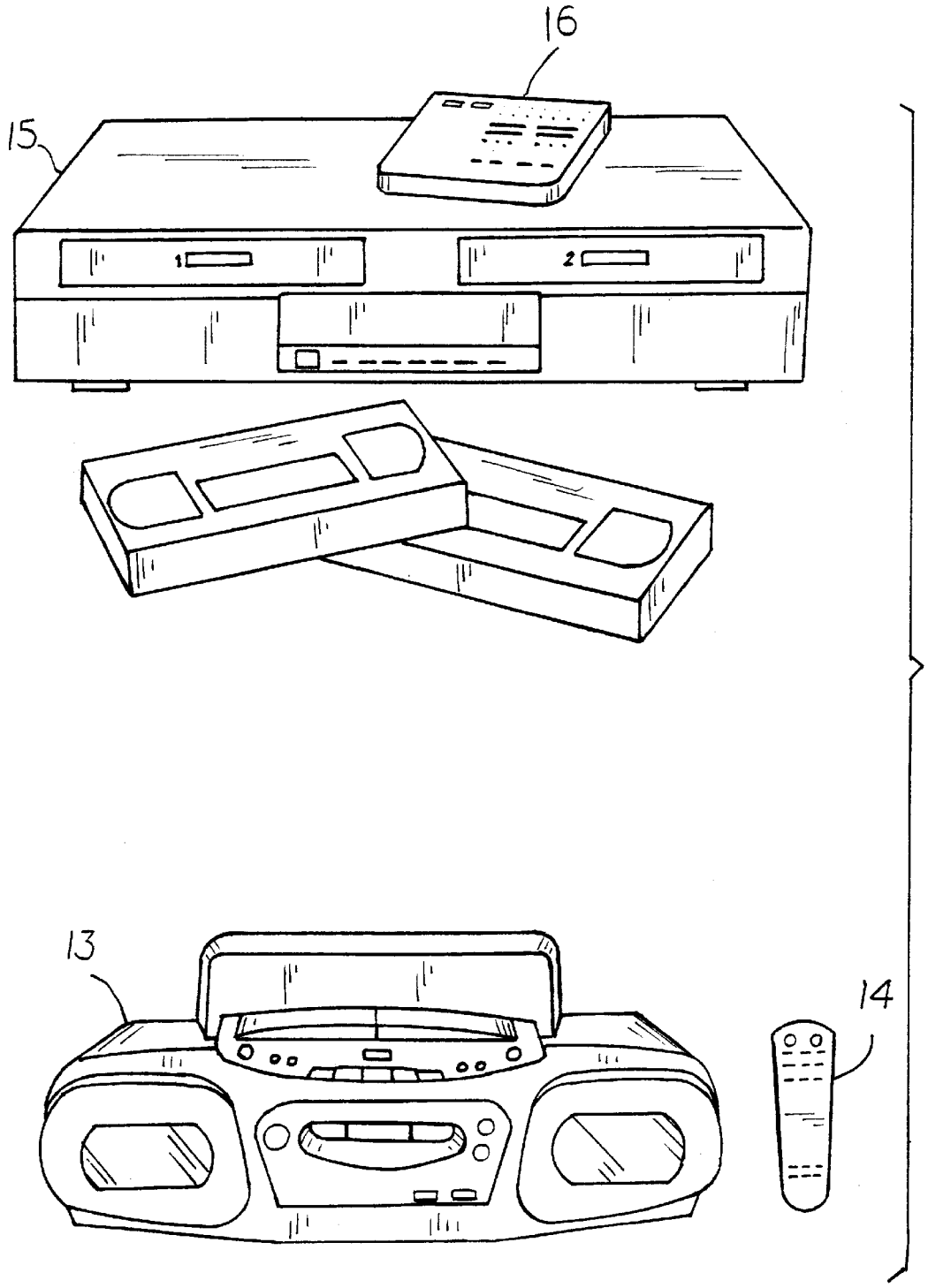
FIGS. 4A–4D are views of consumer products employing remote units which may be adapted to employ the location and recovering mode feature of the present invention.
Figure 4B:
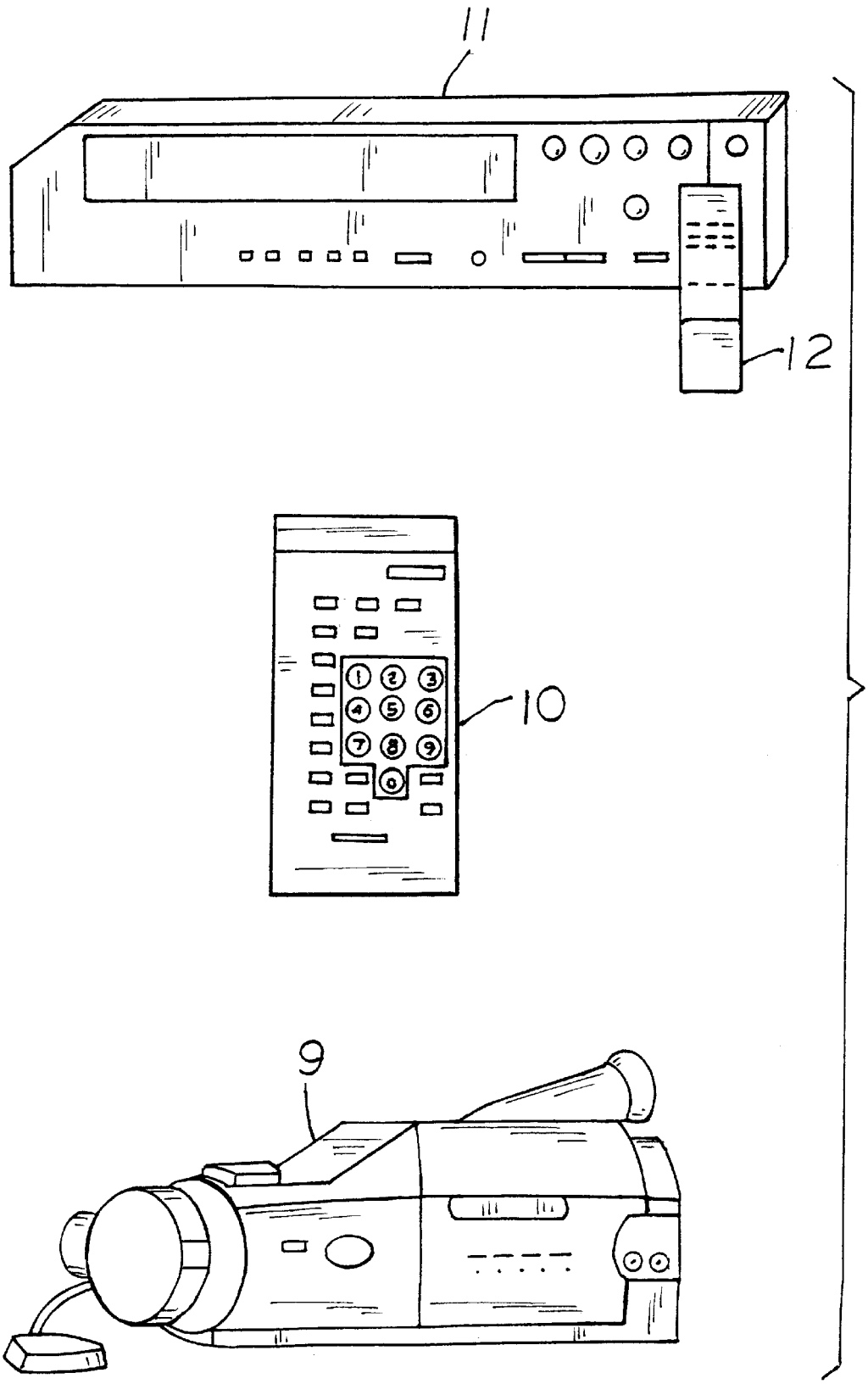
Figure 4C:
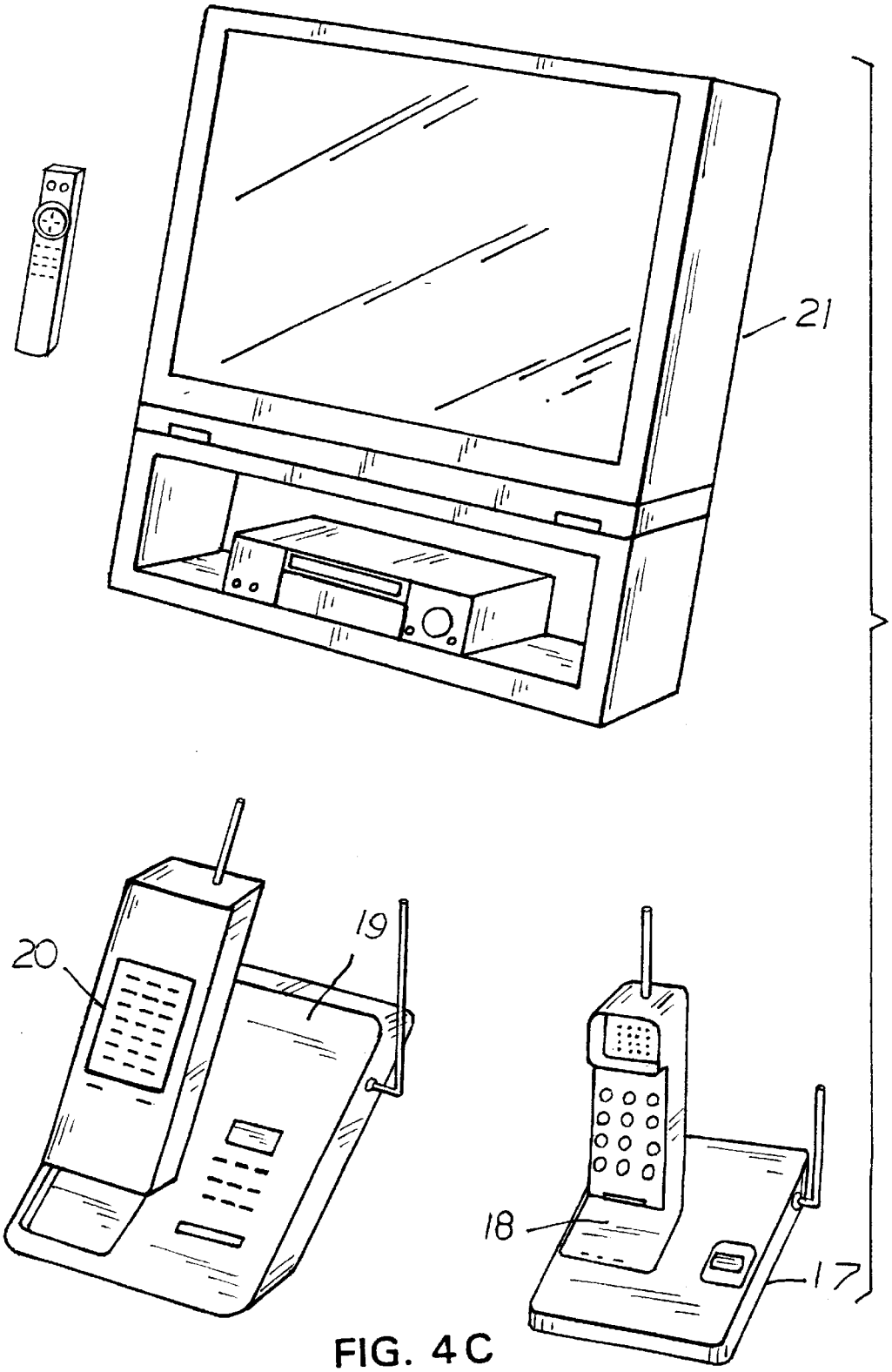
Figure 4D:
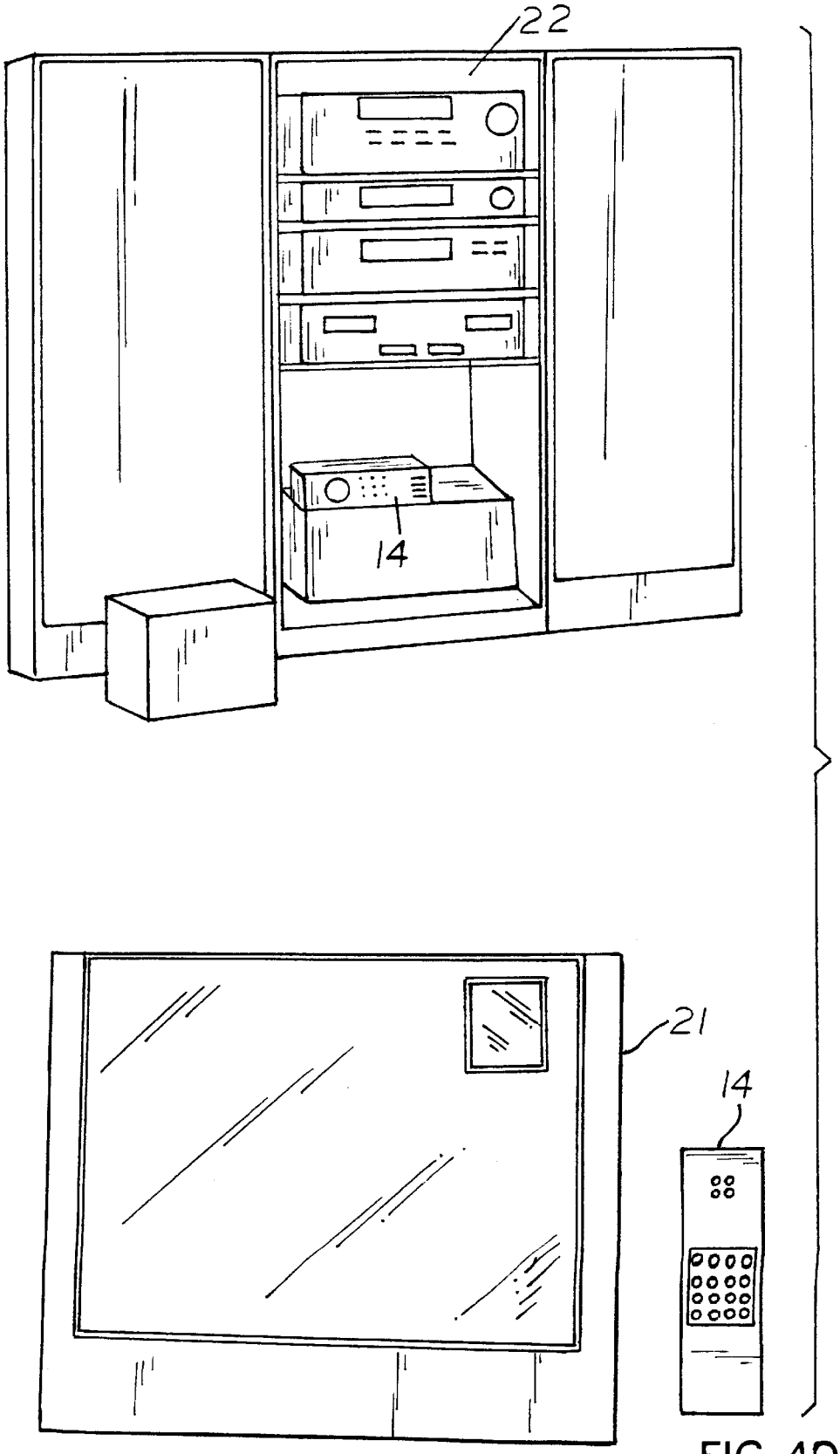

FIGS. 4A–4D are views of consumer products employing remote units which may be adapted to employ the location and recovering mode feature of the present invention. In particular, the locating and recovery feature of the invention may be used in a VCR (FIG. 4A), a portable stereo system (FIG. 4A), a home stereo (FIG. 4B), a portable video camera (FIG. 4B), a television (FIGS. 4C and 4D), a telephone (FIG. 4C), and/or a home entertainment system (FIG. 4D).

The foregoing description of the preferred embodiment of the present invention has been provided for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. An apparatus for locating and recovering a misplaced remote unit, comprising:

a base unit including a radio frequency transmitter adapted to produce radio signals in response to a user command; and a remote unit adapted to control at least one function of the base unit, the remote unit including: (i) a radio frequency receiver adapted to receive the radio signals from the radio frequency transmitter, and (ii) an audio circuit adapted to produce audible musical signals as sensory input to the user in response to the received radio signals, the musical signals being capable of calming the user when the user is under stress such that location and recovery of the remote unit may be obtained.

2. The apparatus of claim 1, wherein the base unit includes a recovery button operatively coupled to the radio frequency transmitter such that the transmitter is activated when the button is pressed by the user.

3. The apparatus of claim 1, wherein the base unit is taken from the group consisting of a television set, a portable stereo, a home stereo, and a video cassette recorder.

4. The apparatus of claim 3, wherein the base unit and remote unit are operatively coupled by way of an infra red communication link such that the remote unit is capable of controlling the at least one function of the base unit.

5. The apparatus of claim 1, wherein the remote unit further comprises a memory device for storing music data, the memory device being operatively coupled to the audio circuit such that the audio circuit is capable of producing the audible musical signals in response to the music data.

6. The apparatus of claim 5, wherein the memory device is a programmable memory adapted to be programmed with music data suitable for producing musical signals which calm the user when the user is under stress.

7. The apparatus of claim 1, wherein the remote unit further includes a lighting circuit operatively coupled to the radio frequency receiver and adapted to produce light signals as sensory input to the user in response to the received radio signals.

8. The apparatus of claim 7, wherein the lighting circuit includes a light emitting diode for producing the light signals.

9. An apparatus for locating and recovering a misplaced telephone handset, comprising:

a base unit including a radio frequency transmitter adapted to produce radio signals in response to a user command; and a telephone handset adapted to enable bi-direction voice communication with the base unit, the telephone handset including: (i) a radio frequency receiver adapted to receive the radio signals from the radio frequency transmitter, and (ii) an audio circuit adapted to produce audible musical signals as sensory input to the user in response to the received radio signals, the musical signals being capable of calming the user when the user is under stress such that location and recovery of the telephone handset unit may be obtained.

10. The apparatus of claim 9, wherein the base unit includes a recovery button operatively coupled to the radio frequency transmitter such that the transmitter is activated when the button is pressed by the user.

11. The apparatus of claim 9, wherein the base unit includes a first transmitter for enabling the bi-directional voice communication with the telephone handset and a second radio transmitter for producing the radio signals which trigger the audible musical signals.

12. The apparatus of claim 9, wherein the telephone handset further comprises a memory device for storing music data, the memory device being operatively coupled to the audio circuit such that the audio circuit is capable of producing the audible musical signals in response to the music data.

13. The apparatus of claim 12, wherein the memory device is a programmable memory adapted to be programmed with music data suitable for producing musical signals which calm the user when the user is under stress.

14. The apparatus of claim 9, wherein the telephone handset further includes a lighting circuit operatively coupled to the radio frequency receiver and adapted to produce light signals as sensory input to the user in response to the received radio signals.

15. The apparatus of claim 14, wherein the lighting circuit includes a light emitting diode for producing the light signals.

* * * * *

UNITED STATES PATENT AND TRADEMARK OFFICE

CERTIFICATE OF CORRECTION

PATENT NO : 5,952,918
DATED : Sept. 14, 1999
INVENTOR(S) : Shalom Ohayon

It is certified that error appears in the above-identified patent and that said Letters Patent is hereby corrected as shown below:

Title page, In the title,

"RECOVERY MODE FEATURE FOR WIRELESS-TELEPHONES AND REMOTE UNITS"

Signed and Sealed this

First Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,952,918
DATED : September 14, 1999
INVENTOR(S) : Shalom Ohayon

It is certified that error appears in the above-identified patent and that said Letters Patent is hereby corrected as shown below:

Title page,
Item [54], should read:

-- RECOVERY MODE FEATURE FOR REMOTE CONTROL UNITS AND WIRELESS TELEPHONE HAND SETS. --

Signed and Sealed this

Eleventh Day of March, 2003

JAMES E. ROGAN
*Director of the United States Patent and Trademark Office*